US007117565B2

(12) United States Patent
Brutsaert

(10) Patent No.: US 7,117,565 B2
(45) Date of Patent: Oct. 10, 2006

(54) SUPPORT FOR FIXING AN ACCESSORY TO A FLEXIBLE ARM

(75) Inventor: Louis Brutsaert, Menen (BE)

(73) Assignee: BRUSTOR, naamloze vennootschap, (BE)

( * ) Notice: Subject to any disclaimer, the term of this patent is extended or adjusted under 35 U.S.C. 154(b) by 0 days.

(21) Appl. No.: 10/888,007

(22) Filed: Jul. 12, 2004

(65) Prior Publication Data

US 2005/0011044 A1 Jan. 20, 2005

(30) Foreign Application Priority Data

Jul. 18, 2003 (BE) ..... 2003/0413
Nov. 24, 2003 (BE) ..... 2003/0630

(51) Int. Cl.
*E05D 5/10* (2006.01)

(52) U.S. Cl. ..... 16/386; 160/127; 160/66

(58) Field of Classification Search ..... 160/222, 160/223, 231, 261, 263, 270, 322, 280, 281, 160/22, 26, 29, 127, 66, 67, 70, 79; 135/139, 135/130; 362/602, 258; 248/565; 16/386; 52/73–78

See application file for complete search history.

(56) References Cited

U.S. PATENT DOCUMENTS 2,616,648 A * 11/1952 Budreck ..... 248/487
3,355,695 A * 11/1967 Overesch ..... 439/31
3,612,145 A * 10/1971 Darula et al. ..... 160/67
3,782,443 A * 1/1974 Clauss et al. ..... 160/22
4,418,793 A * 12/1983 Brent ..... 182/129
4,837,667 A * 6/1989 Grau ..... 362/147
5,148,849 A * 9/1992 Faludy ..... 160/67
5,197,797 A * 3/1993 Jaksich ..... 362/219
5,369,919 A * 12/1994 Lohausen ..... 52/73
5,913,380 A * 6/1999 Gugel et al. ..... 182/129
5,995,373 A * 11/1999 Nagai ..... 361/755
6,206,462 B1 * 3/2001 Huang ..... 297/39
2003/0230331 A1 * 12/2003 Li ..... 135/910
2005/0039861 A1 * 2/2005 Faludy et al. ..... 160/66

FOREIGN PATENT DOCUMENTS

DE 92 08 343 U1 10/1993
DE 29716249 U1 * 1/1998
EP 1 321 600 A2 6/2003
FR 2709322 A1 * 3/1995

* cited by examiner

*Primary Examiner*—Chuck Y. Mah
*Assistant Examiner*—Mark T. Vogelbacker
(74) *Attorney, Agent, or Firm*—Bacon & Thomas PLLC

(57) ABSTRACT

Support for fixing an accessory (3) to a flexible arm (1), characterized in that this support (2) comprises at least one leg (11) fixed with one far end (13) to one of the far ends (6–7) of adjoining hinge-mounted parts (4–5) of the flexible arm (1) which are connected to each other in a hinged manner.

14 Claims, 6 Drawing Sheets

SUPPORT FOR FIXING AN ACCESSORY TO A FLEXIBLE ARM

BACKGROUND OF THE INVENTION

1. Field of the Invention

The present invention concerns a support for fixing an accessory to a flexible arm.

More particularly, the invention concerns a support for fixing an accessory such as a lighting armature, a fan or the like to a flexible arm of an awning, sunshade or the like.

SUMMARY OF THE INVENTION

The invention aims a support which makes it possible for an accessory to be fixed to a flexible arm and to remain fixed to the arm when this arm is unfolded or folded up, such that the accessory can be put away together with the arm and can always remain mounted on the arm while the flexible arm is in use in the unfolded position, such that the accessory can at all times be used without having to be mounted or installed first.

To this end, the invention concerns a support for fixing an accessory to a flexible arm, whereby this support comprises at least one leg fixed with one far end to one of the far ends of adjoining hinge-mounted parts of the flexible arm which are connected to each other in a hinged manner.

The support is preferably situated in the extension or practically in the extension of the flexible arm when it is folded up, such that the accessory can be put away in the extension of the flexible arm in a space-saving manner when the arm is not in use.

BRIEF DESCRIPTION OF THE DRAWINGS

In order to better explain the characteristics of the invention, the following preferred embodiments of a support according to the invention for fixing an accessory to a flexible arm are described as an example only without being limitative in any way, with reference to the accompanying drawings, in which.

DESCRIPTION OF THE PREFERED EMBODIMENT

Figure 1:
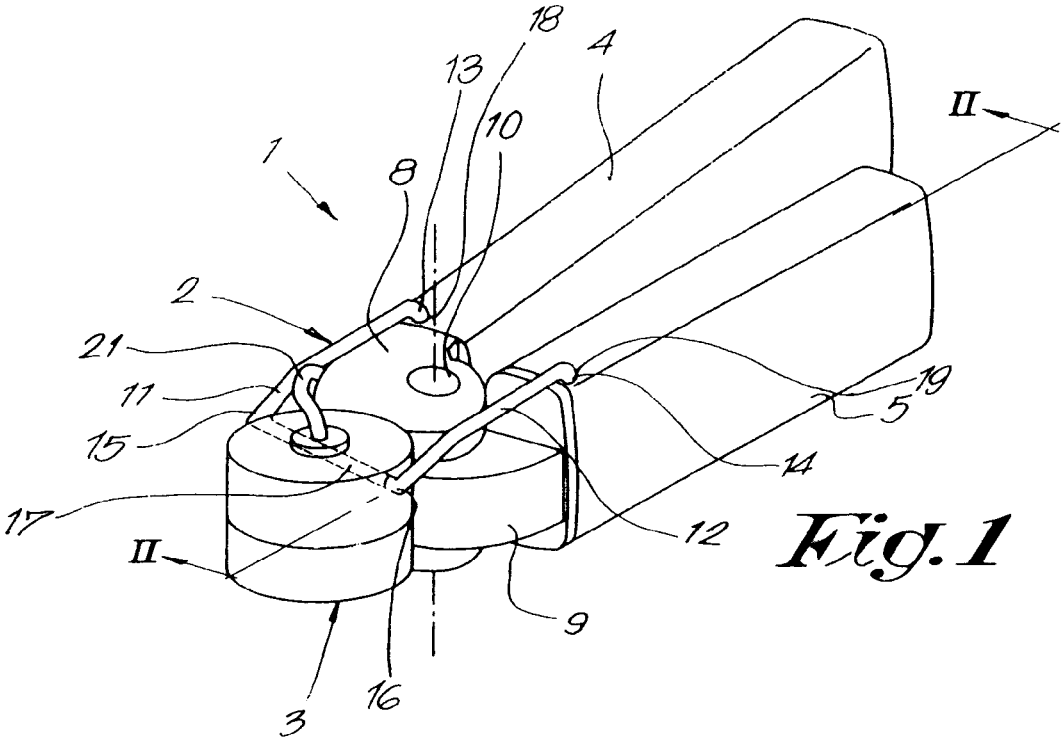
FIG. 1 schematically represents a part of a flexible arm which is equipped with a support according to the invention onto which is fixed an accessory in perspective.
Figure 2:
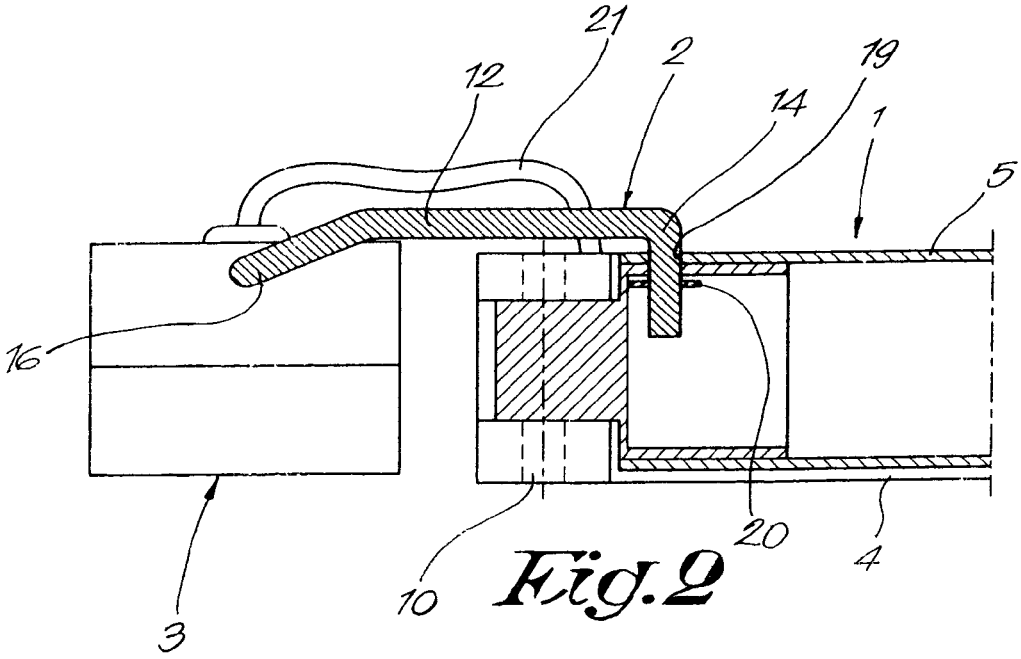
FIG. 2 represents a section according to line II—II in FIG. 1 to a larger scale.

FIGS. 1 and 2 represent a part of a flexible arm 1 which is provided with a support 2 for fixing an accessory 3, in this case a lighting armature.

The flexible arm 1 in this case consists of two hinge-mounted parts, 4 and 5 respectively, in the shape of struts or the like, which are each connected to each other at connected ends 6–7 of the struts in a hinged manner, to which ends these connected ends 6–7 are provided with an end part 8–9 with ears through which has been provided a hinge pin 10.

In the given example, the support 2 is formed of an elastic, bar-shaped material, such as steel or the like, and it is made U-shaped with legs 11–12 whose free ends (or first ends) 13–14 are bent at right angles and whose far ends (or secured ends) 15–16 are connected to each other by means of a bridge 17.

The support 2 is fixed to the flexible arm 1 as it is set in a bore hole 18–19 with each of its bent far ends 13–14 in each of the connected ends 6–7 of hinge-mounted parts 4, 5, of the flexible arm 1 which are connected to each other in a hinged manner, whereby these bore holes 18–19 are in this case parallel to or practically parallel to the above-mentioned hinge pin 10 are preferably but not necessarily situated at an equal distance from this hinge pin 10.

The bent far ends 13–14 are secured in the axial direction by means of a locking ring 20 or the like.

The legs 11–12 can be bent or buckled as in the given example, but they can also be straight or have any other form whatsoever, and they preferably extend in the prolongation of the hinge-mounted parts 4–5 of the flexible arm 1, when this arm 1 is folded up, as represented in FIG. 1.

The accessory 3 can be fixed to the support 2 in any way whatsoever, but in the given example it is suspended more in particular to the bridge 17 of the support 2, as this bridge 17 protrudes through the housing of the accessory.

The accessory 3 is further provided with an electric cord 21 which extends via a passage 22 in the hinge-mounted part 4 of the flexible arm 1 through the strut of this part 4, and which is connected to an electric circuit with which the accessory 3 can be switched on or off.

The use of the support 2 according to the invention is very simple and as follows.

When the flexible arm 1 is folded up, as represented in FIG. 1, the accessory 3 will be situated in the extension of, or approximately in line with, this folded arm 1, so that the flexible arm and the accessory will occupy only little space widthwise, which may be advantageous when the arm 1 has to be put away together with the accessory 3.

In this case, it may be advantageous if the width of the support 2 and of the accessory 3 is smaller than the width of the flexible arm 1.

Figure 3:
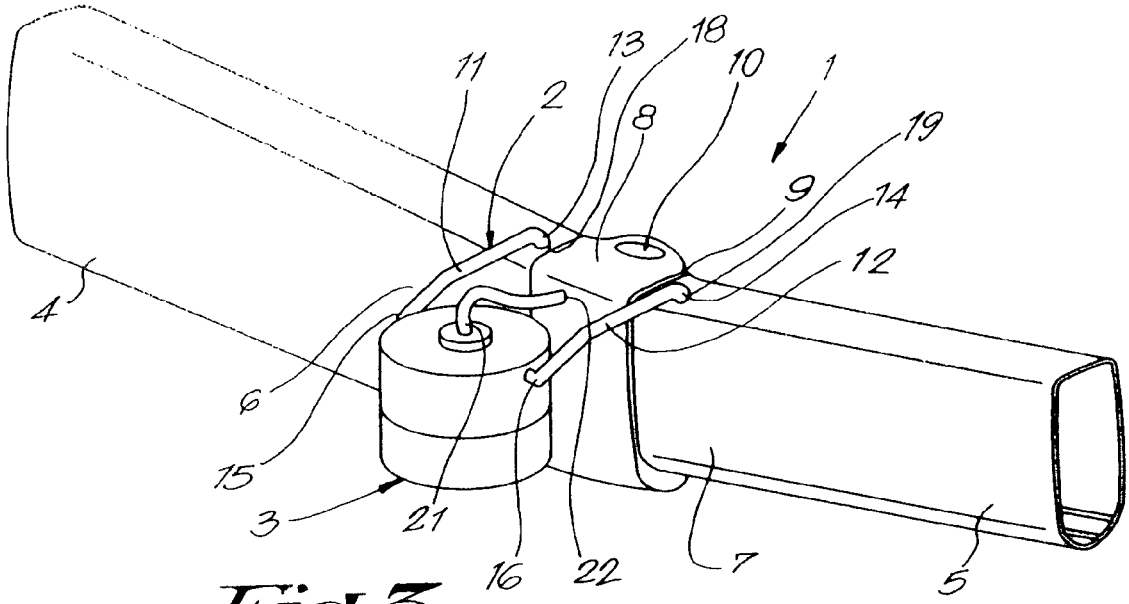
FIG. 3 represents the flexible arm of FIG. 1, but as unfolded.

When the flexible arm 1 is being unfolded, as represented in FIG. 3, the support 2 will be in a position whereby the legs 11–12 are directed crosswise to the unfolded arm 1 and the accessory 3 is situated next to the arm 1 at a suitable distance from the arm 1, which distance is determined by the length of the legs 11–12.

It is clear that the length of both legs 11 and 12 must not be necessarily equal, but that they may have a different length which is adapted to the required position of the accessory 3 when put away and when in use.

Although, in the given example, the legs 11–12 are directly connected to each other by means of a bridge 17, it is not excluded for these legs 11–12 to be indirectly connected to each other, for example by means of the accessory 3 itself, without the agency of a bridge 17.

Preferably, at least one or both bent far ends 13–14 of the legs 11–12 of the support 2 are hinge-mounted to the connected ends 6–7 of the hinge-mounted parts 4–5 of the flexible arm 1.

Figure 4:
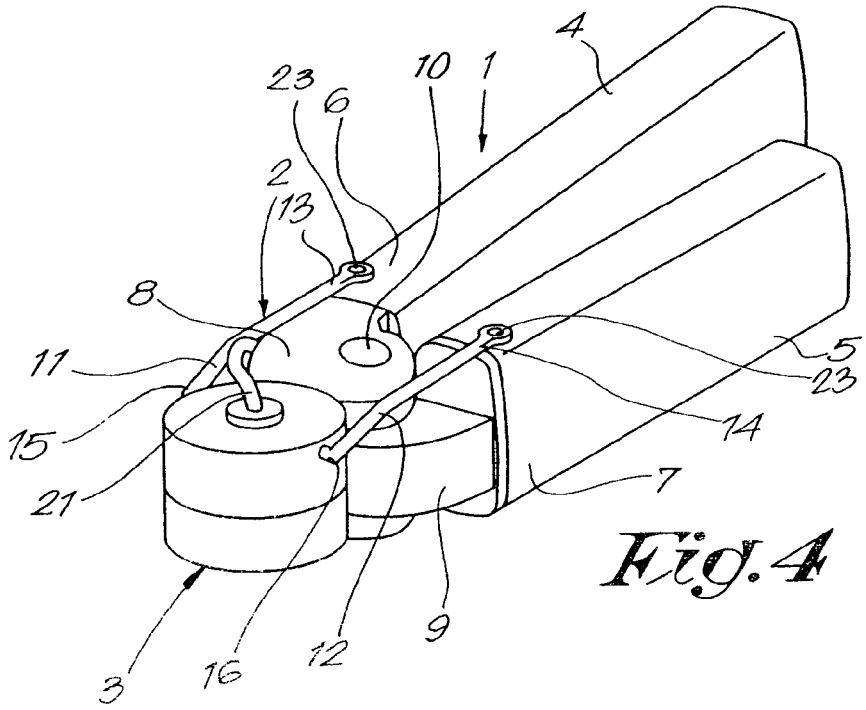
FIGS. 4 and 5 represent variants of FIG. 1.

FIG. 4 represents a variant whereby these far ends 13–14 are not bent but are hinge-mounted to the arm 1 by means of pivots 23.

It is clear that the legs 11–12 must not be necessarily fixed at the top of the arm 1 with their far ends 13–14, but that they can also be fixed at the bottom or even to the side walls of the arm 1.

Figure 5:
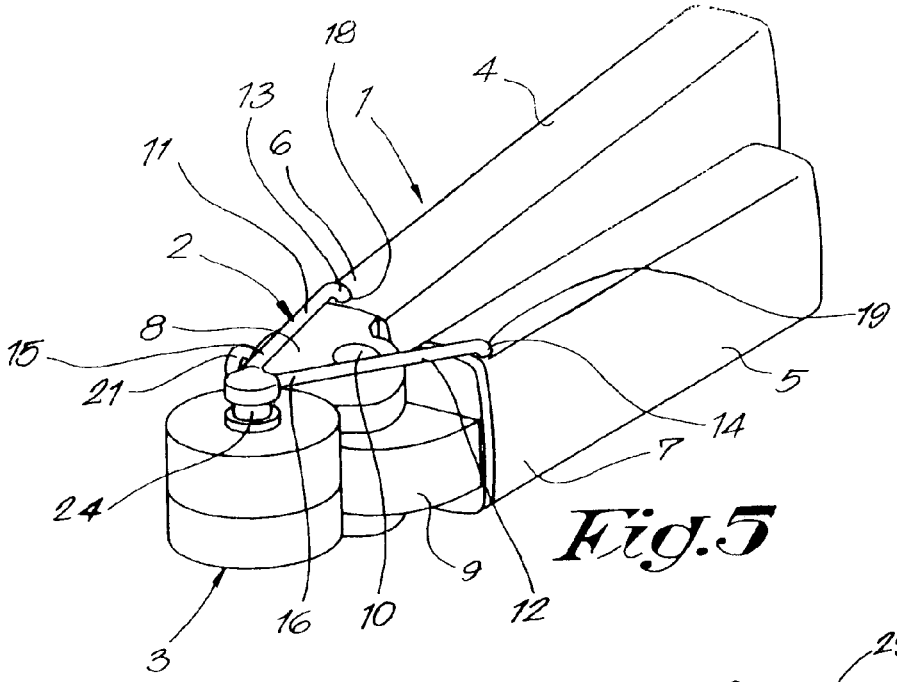

FIG. 5 represents a variant whereby the support is made V-shaped and whereby the far ends 15–16 of the legs 11–12 are connected to each other in a hinged manner by means of a pivot 24 onto which the accessory 3 is fixed.

Figure 6:
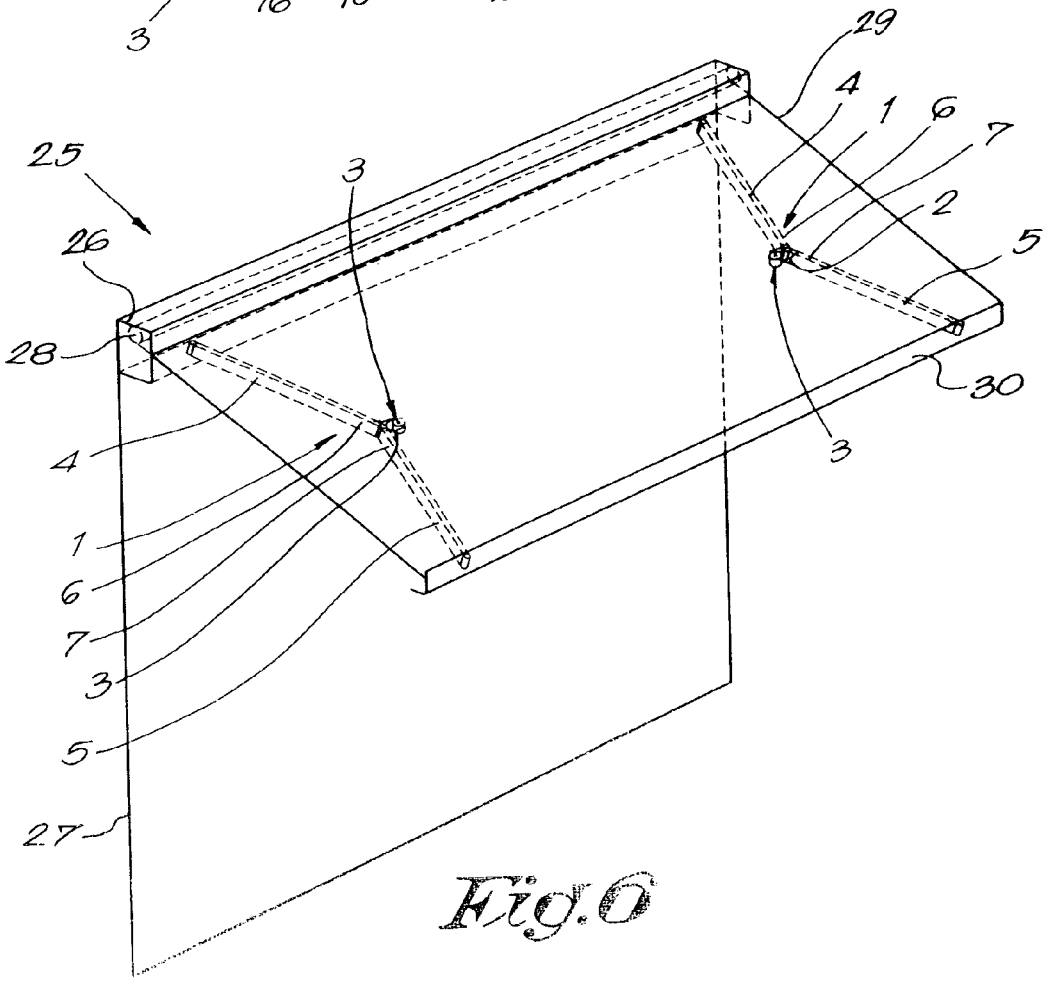
FIG. 6 represents an unfolded awning with flexible arms which are provided with a support with an accessory mounted onto it.
Figure 7:
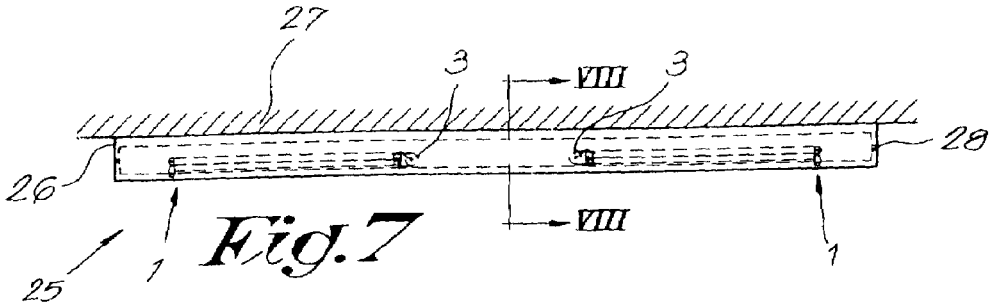
FIG. 7 represents a top view of the awning from FIG. 6, but as folded up.
Figure 8:
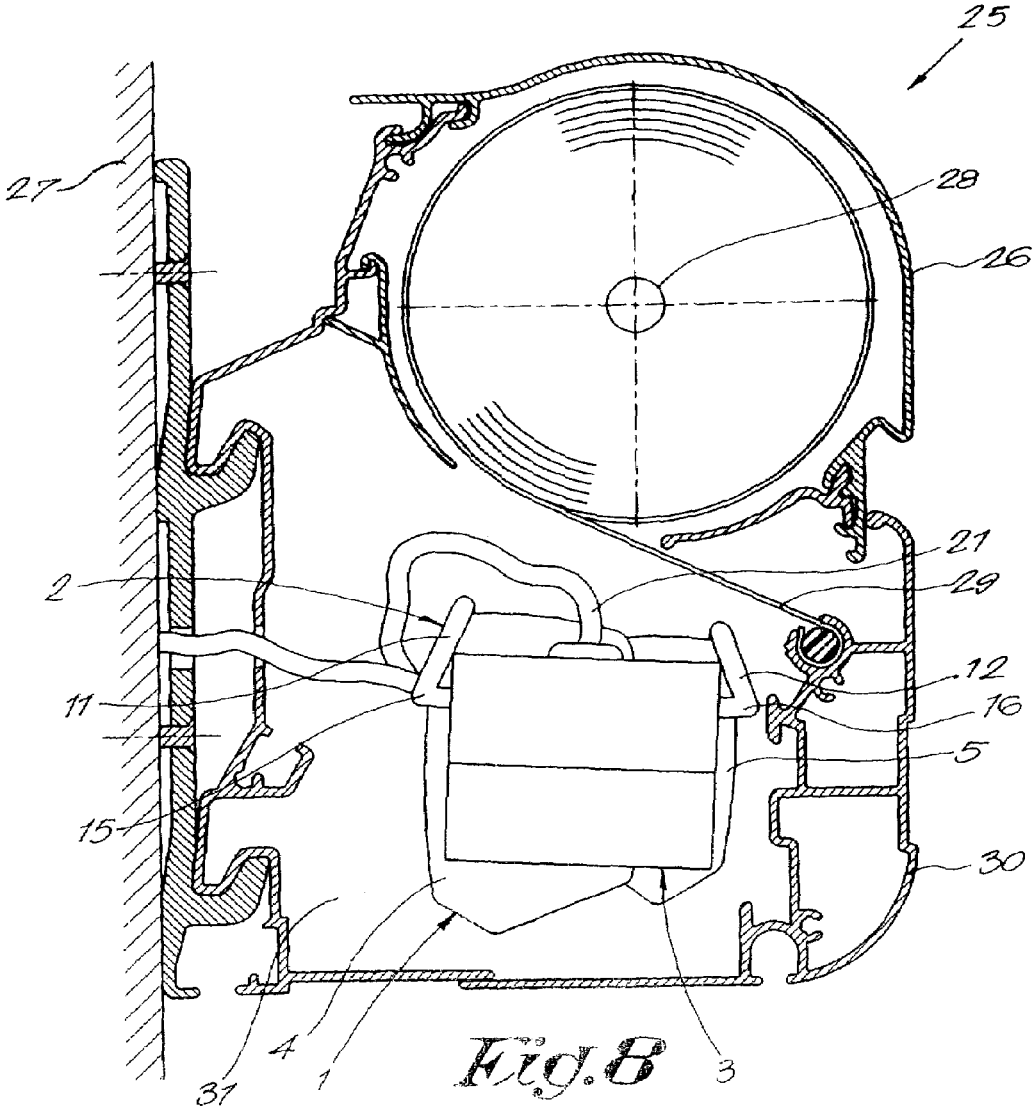
FIG. 8 represents a section according to line VIII—VIII in FIG. 7 to a larger scale.

By way of example, FIGS. 6 to 8 represent an application in the shape of an awning 25 which mainly consists of a casing 26 provided against a wall 27 and in which has been provided a collapsing mechanism 28 for a cloth 29, which cloth 29 is fixed to a cover mould (cover) 30 with one edge, provided on an operating mechanism which is formed, in the known manner, of two or more flexible arms 1, in this case two arms 1 which are each hinge-mounted in the casing 28 with one far end, and which are in this case equipped with a support 2, as is represented in FIG. 1, for fixing an accessory 3.

FIG. 6 represents the awning 25 when in use, whereby the cloth 29 is unrolled and the arms 1 are unfolded, whereas in FIGS. 7 and 8, the awning 25 is represented as put away, whereby the cloth 29 is rolled up and the arms 1 are situated entirely within the space 31 of the casing 26 as they are folded up, and whereby the cover mould 30 seals the opening on the front side of the casing 28.

As is clear from FIG. 8, the dimensions and the shape of the support 2 and of the accessory 3 are such that they are situated entirely within the space 31 of the casing 26 when the awning 25 is rolled up.

Figure 9:
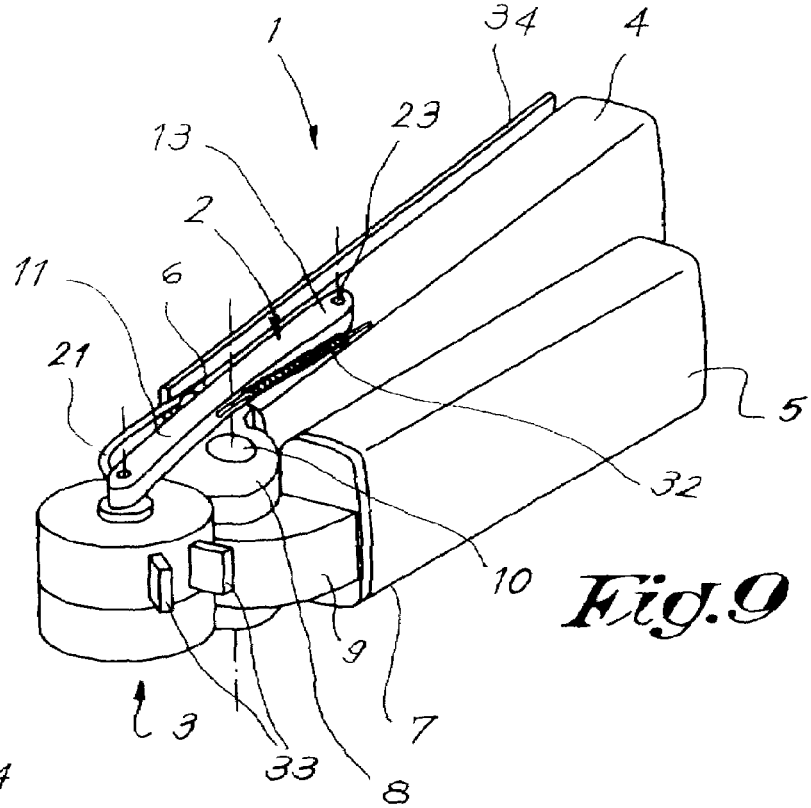
FIG. 9 represents a variant from FIG. 1.
Figure 10:
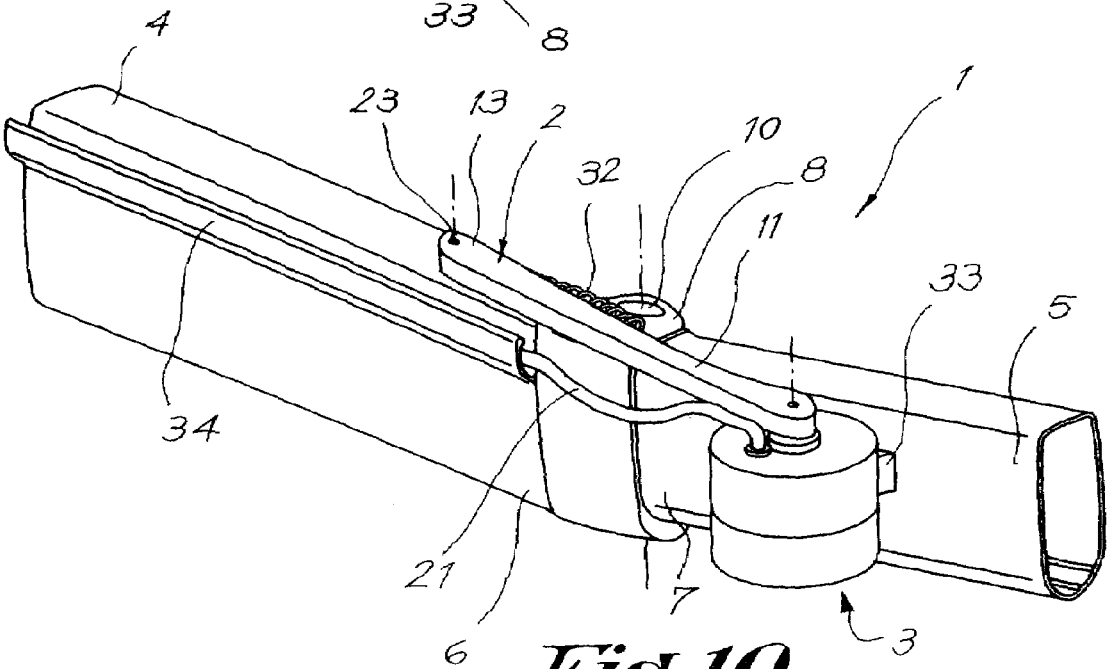
FIG. 10 represents the variant from FIG. 9, but for another position.

FIGS. 9 and 10 represent another variant of a support 2 according to the invention, whereby this support 2 is formed of a single leg 11 in this case which is hinge-mounted to the hinged part 4 of the flexible arm 1 by means of a pivot 23, and whereby a release spring 32 is provided between this leg 11 and the hinged part 4.

In this case, two spacer sleeves 33 are provided on the accessory 3 which can work in conjunction with the second hinged part 5 of the flexible arm 1.

The hinged part 4 in this case also comprises a duct 34, disposed alongside the hinged part 4, in which the cord 21 is provided.

When the arm 1 is folded up, the support 2, as represented in FIG. 9, is drawn into a position in which the support 2 is situated in the extension or practically in the extension of the folded arm 1.

When, starting from the position in FIG. 9, the arm 1 is unfolded, the hinged part 5, as represented in FIG. 10, makes contact with the above-mentioned spacer sleeves 33, and the accessory 3, as the flexible arm 1 is turned further open, is pushed aside.

Figure 11:
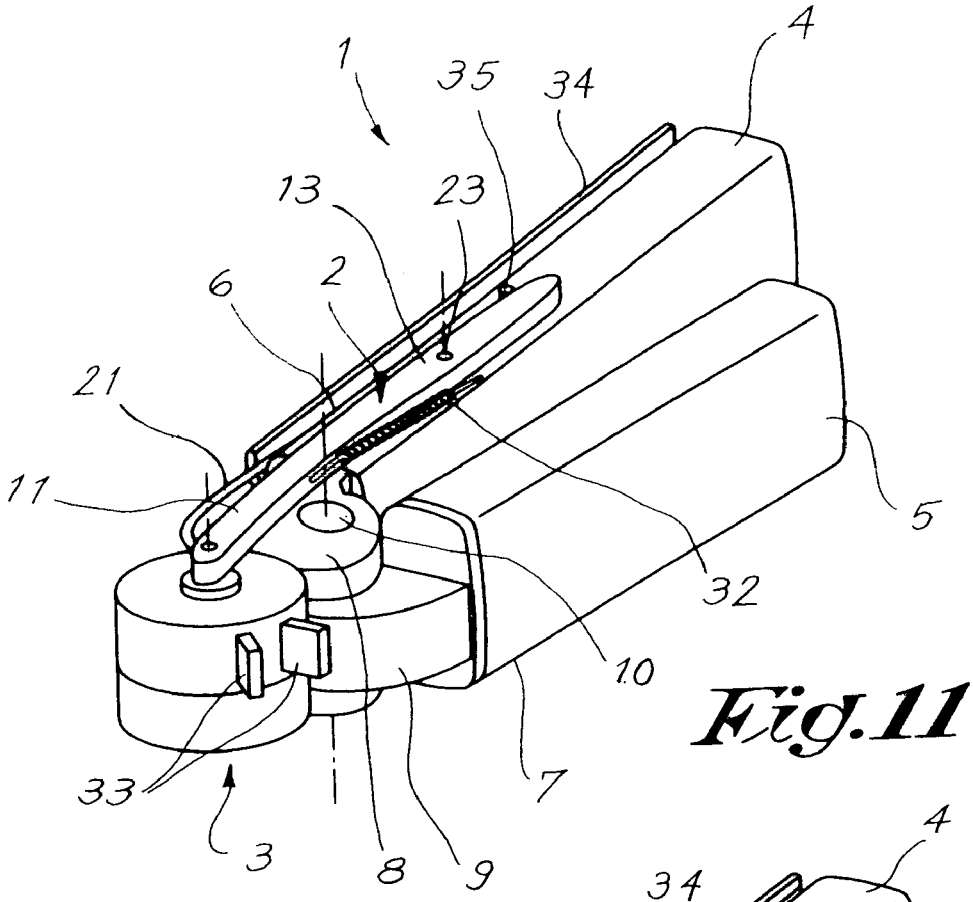
FIGS. 11 and 12 represent two more variants from FIG. 1.

FIG. 11 represents a variant, whereby the leg 11 is in this case drawn against a stop 35 by the return spring 32 when the flexible arm 1 has been folded up.

Figure 12:
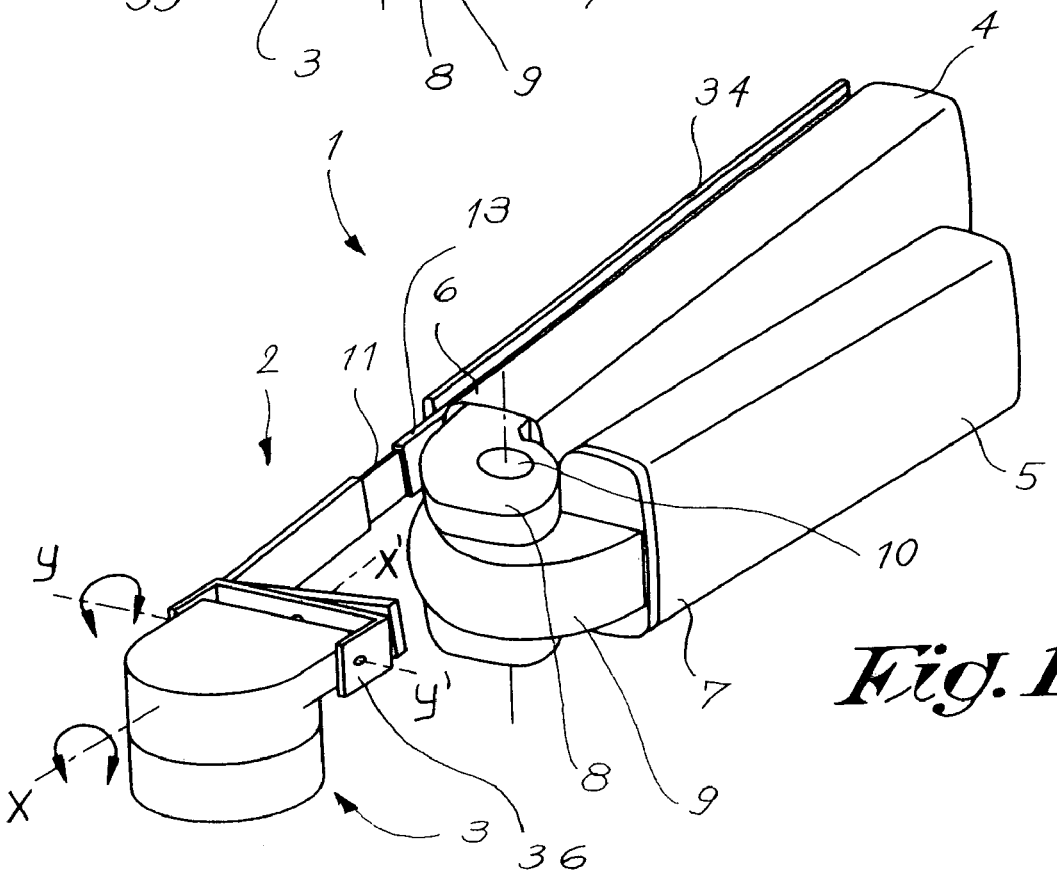

FIG. 12 represents another variant of a support 2 according to the invention, whereby the leg 11 is in this case made as an L-shaped bent lath made of a resilient material and which is fixed to the hinged part 4 with one far end 13, for example by means of clamping in the above-mentioned duct 34.

The accessory 3 is in this case fixed to the support 2 by means of a bracket 36 which is provided to the support 2 in a rotating manner and which can for example be rotated around two geometric axes X–X' and Y–Y'.

When the flexible arm 1 is unfolded, the accessory 3 will be pushed outward by the hinged part 5, against the resilience of the flexible material out of which the support 2 is made.

The invention is by no means limited to the above-described embodiments given as an example and represented in the accompanying drawings; on the contrary, such a support according to the invention for fixing an accessory to a flexible arm can be made in all sorts of shapes and dimensions while still remaining within the scope of the invention.

The invention claimed is:

1. An awning, including a support fixing an accessory to an awning, said awning having a casing and a cover for closing the casing defining a space, a collapsing mechanism for a cloth which is fixed at one edge to the cover, and said collapsing mechanism comprising an operating mechanism for the cover formed of two or more flexible arms provided between the casing and the cover, the flexible arms each comprising a pair of struts connected together at connecting ends by a hinge and adapted to be extended from the casing in an open position or folded into the casing in a completely folded position, the support comprising:

at least one leg having a first end fixed to the connecting end of one of said struts, and a second end that becomes situated in line with one of said flexible arms in the completely folded position, wherein the shape and dimensions of the support and of the accessory are such that the support and the accessory are situated entirely within the space of the casing when the flexible arms are folded into the casing.

2. The support according to claim 1, wherein said at least one leg is made of an elastic material.

3. The support according to claim 1, wherein a duct is disposed lengthwise alongside said one of said struts, and said first end of said at least one leg is fixed in said duct.

4. The support according to claim 1, wherein said first end of said at least one leg is hinge-mounted to said end of one of said struts proximate to said hinge.

5. The support according to claim 4, further comprising a stop for said at least one leg, the stop being configured and arranged so that said at least one leg makes contact with said stop when said one flexible arm is in the completely folded position.

6. The support according to claim 4, further comprising a spring provided between said at least one leg and said one flexible arm.

7. The support according to claim 1, further comprising at least one spacer sleeve configured and arranged to space the accessory from one of said struts.

8. The support according to claim 1, comprising two legs each having a first end and a second end, the first ends being respectively fixed to a connecting end of one of said struts proximate to said hinge, the second ends being coupled to each other.

9. The support according to claim 8, wherein the first end of at least one of said two legs is hinge mounted to the connecting end of one of said struts.

10. The support according to claim 8, wherein the second ends of said two legs are hinge-mounted to each other.

11. The support according to claim 8, wherein the second ends of said two legs are situated at an equal distance from a hinge pin of the hinge of said flexible arm.

12. The support according to claim 8, wherein said two legs have the same length.

13. The support according to claim 1, wherein at least one of said struts is provided with a cable duct to guide an electric cord for connecting said accessory.

14. The support according to claim 1, wherein said accessory is a lighting element.

* * * * *